US009468275B2

(12) United States Patent
Silberman

(10) Patent No.: US 9,468,275 B2
(45) Date of Patent: Oct. 18, 2016

(54) WIND RESISTANT BEACH UMBRELLA

(71) Applicant: Alan R. Silberman, Tenafly, NJ (US)

(72) Inventor: Alan R. Silberman, Tenafly, NJ (US)

( * ) Notice: Subject to any disclaimer, the term of this patent is extended or adjusted under 35 U.S.C. 154(b) by 0 days.

(21) Appl. No.: 14/224,213

(22) Filed: Mar. 25, 2014

(65) Prior Publication Data

US 2014/0326283 A1 Nov. 6, 2014

Related U.S. Application Data

(60) Provisional application No. 61/817,944, filed on May 1, 2013.

(51) Int. Cl.

| | |
|---|---|
| ***A45B 25/22*** | (2006.01) |
| ***A45F 3/44*** | (2006.01) |
| ***E04H 12/22*** | (2006.01) |
| *A45B 23/00* | (2006.01) |

(52) U.S. Cl.

CPC ..... *A45B 25/22* (2013.01); *A45F 3/44* (2013.01); *E04H 12/2215* (2013.01); *A45B 2023/0012* (2013.01)

(58) Field of Classification Search

CPC A45B 3/00; A45B 2023/0012; A45B 25/22; E04H 15/28; E04H 12/2215; A47B 37/04; A45F 3/44

USPC ..... 135/118, 119, 120.4, 95, 905, 96, 98, 135/16, 15.1; 248/156, 530, 508; 52/156–157

See application file for complete search history.

(56) References Cited

U.S. PATENT DOCUMENTS

| | | | | |
|---|---|---|---|---|
| 4,249,715 | A * | 2/1981 | Repp | 248/545 |
| 4,649,678 | A * | 3/1987 | Lamson | 52/103 |
| 5,524,855 | A * | 6/1996 | Lesar | 248/530 |
| 5,662,304 | A * | 9/1997 | McDaniel | 248/499 |
| 6,234,444 | B1 * | 5/2001 | Haddad | 248/545 |
| 6,334,596 | B1 * | 1/2002 | Temple | 248/156 |
| 6,338,465 | B1 * | 1/2002 | Stoner | 248/530 |
| 6,715,503 | B2 * | 4/2004 | Brooks, III | 135/16 |
| 6,779,764 | B1 * | 8/2004 | Gretz | 248/156 |
| 7,735,166 | B1 * | 6/2010 | Weeks | 5/127 |
| 2002/0185167 | A1 * | 12/2002 | Lin et al. | 135/16 |
| 2007/0246091 | A1 * | 10/2007 | Becker | 135/16 |
| 2013/0272800 | A1 * | 10/2013 | Kelleher | 405/244 |

* cited by examiner

*Primary Examiner* — Winnie Yip

(74) *Attorney, Agent, or Firm* — Gottlieb, Rackman & Reisman, PC

(57) ABSTRACT

An improved beach umbrella that includes a canopy, a cylindrical shaft with a point on the lower end, and one or more wedges that are attached to the shaft. The wedges act as anchors for the umbrella when placed into the ground to prevent the umbrella from being uplifted from the ground due to a strong force of wind.

18 Claims, 3 Drawing Sheets

WIND RESISTANT BEACH UMBRELLA

RELATED APPLICATIONS

This application claims priority to U.S. provisional application Ser. No. 61/817,944 filed May 1, 2013 and incorporated herein by reference in its entirety.

BACKGROUND OF THE INVENTION

A. Field of Invention

The present application pertains to a beach umbrella, and more particularly, a beach umbrella having a shaft arranged and constructed to provide increased resistance when the umbrella is subjected to wind thereby greatly reducing the likelihood of the shaft being pulled out from the sand.

B. Background of the Invention

Going to the beach is a favorite activity for people of all ages. However, the sun tends to be fairly strong at the beach. Moreover, even during an overcast or hazy day, ultra violet radiation is known to be dangerous and people should not be exposed to it for too long. Exposure to the Sun's radiation is particularly dangerous to young children, and people taking certain medicines. Therefore, to avoid exposure to the Sun's rays people often use a temporary shelter, such as a beach umbrella or a tent, to protect themselves from this harmful radiation. Typically, beach umbrellas include a sheet of fabric or other light-weight material stretched over a generally parabolic shaped frame and secured to the ground by a shaft having a pointed tip so that it can be pushed into the sand, and then removed easily.

One problem with such beach umbrellas is that because they are light and have a large surface area, a gust of wind or even a relatively light breeze can, due to the airfoil-like shape of the canopy generate a lifting force on the surface that tends to pull the shafts out of the ground. When that happens, the beach umbrella is no longer secure, and may be lifted out of the sand and blow away. This is highly undesirable and dangerous because as the shelter is upended and blown away, it can cause serious injury to other beachgoers and damage to property.

A typical beach umbrella includes a generally round canopy having the shape of an inverted bowl and mounted on a frame formed of a plurality of radial wires secured to a vertical center shaft. Many umbrellas are collapsible so that they can be deployed or removed quickly and can be carried easily. Some umbrellas have more complex canopies to accommodate two or more users.

There have been several attempts made in the past to insure that umbrellas are not pulled out of the ground easily by wind, however, none of these attempts were very successful. For example, the canopy of some umbrellas were provided with one or more openings or flaps (usually near the umbrella peaks) that allow air pressure to equalize on its two sides, and thereby reduce the lifting forces from wind. However, these vents render the structure of the umbrella significantly, hence umbrellas with vents are more expensive and the vents alone are not always sufficient to prevent the umbrella from being lifted by a wind gust.

Another proposed solution involved reducing the radius of curvature of the canopy (e.g., by making it flatter). However, it is difficult to make and operate such umbrellas because the forces on ribs become very large, and such umbrellas do not provide as much shade if the Sun's rays are at a low angle.

Umbrellas and other temporarily shelters are also sometimes anchored by guy wires extending at an angle from the canopy to several anchoring points. These arrangements require a much larger space than the area actually covered by the temporary shelter itself. Moreover the guy wires are expensive, unsightly, and represent a tripping hazard.

Umbrellas with a helix secured to the bottom of the shaft have been suggested. However this arrangement requires a very large insertion torque that can be developed only by adding handles or other perpendicular arms to the shaft. This handles are arm are expensive, render the shaft more complex, and esthetically they are unsightly.

Another suggested solution included a rotatable helix added to the shaft tip. Internal gearing was provided inside the shaft for selective rotation of the helix. This solution also renders the shaft more complex and expensive to manufacture. Moreover, the proposed structure is prone to failure over time due to rust forming on the internal gearing due to the intense humidity and salinity of the air from the ocean nearby, and the probability that no matter what precautions are taken, sand will eventually clog the internal gearing.

Yet another suggested solution included adding helical wings on the shaft using screws or other means. Again, this solution increases the complexity and is expensive. Moreover, these wings increase the size of the shelter and its installation on the beach (if they come separately) is difficult, requiring various tools.

In summary, as any beach goer knows only too well, none of the solutions suggested so far have been proven entirely satisfactory, and as a result, even on a relatively calm day, it is not uncommon to see upended umbrellas rolling or flying along a beach and being chased by their unhappy owners.

SUMMARY OF THE INVENTION

The present inventor has found a solution that eliminates or at least greatly reduces the chances that an umbrella or other similar temporarily shelter anchored in the sand is upended and blown away by wind.

This invention provides a means of securing a temporary shelter such as an umbrella into sand, via a shaft or other similar anchoring means, wherein the shaft is constructed to generate a holding force that is much larger than the holding force of prior art anchoring means.

As described above, temporary shelters for the beach, including beach umbrellas and the like, conventionally include one or more shafts that are sunk into the sand to provide an anchor. Until now these shafts included an elongated body, generally having a circular cross-section terminating in a sharp tip. (Some umbrellas have a shaft with an oval or polygonal cross section). The tip is configured to facilitate insertion of the shaft into sand. According to the present invention, one or more wedges are attached to the shaft. The wedges are arranged and constructed to make it significantly more difficult to pull the shaft out of the sand, thereby providing wind resistance to the shelter. More specifically, the wedges have a generally triangular profile when viewed from the side with a point directed downwardly and a base angled slightly upwardly. The wedges may be made of a wood or wood composite, a high impact plastic material, metal, etc.

Each wedge may have a generally triangular shape as viewed from the side. The two sides may taper toward each other so that the wedge is thinner at the bottom than at the top to facilitate the insertion or planting of the umbrella into the ground.

In one embodiment, the wedges are arranged in diametrically opposed pairs near the bottom of the shaft. Each wedge is attached by a bolt and a nut, or by adhesive or other conventional means. The wedges are shaped and constructed so that shaft can be introduced relatively easily into the sand but is much harder to withdraw if one pulls vertically on the shaft.

DETAILED DESCRIPTION OF THE PREFERRED EMBODIMENT

Figure 1:
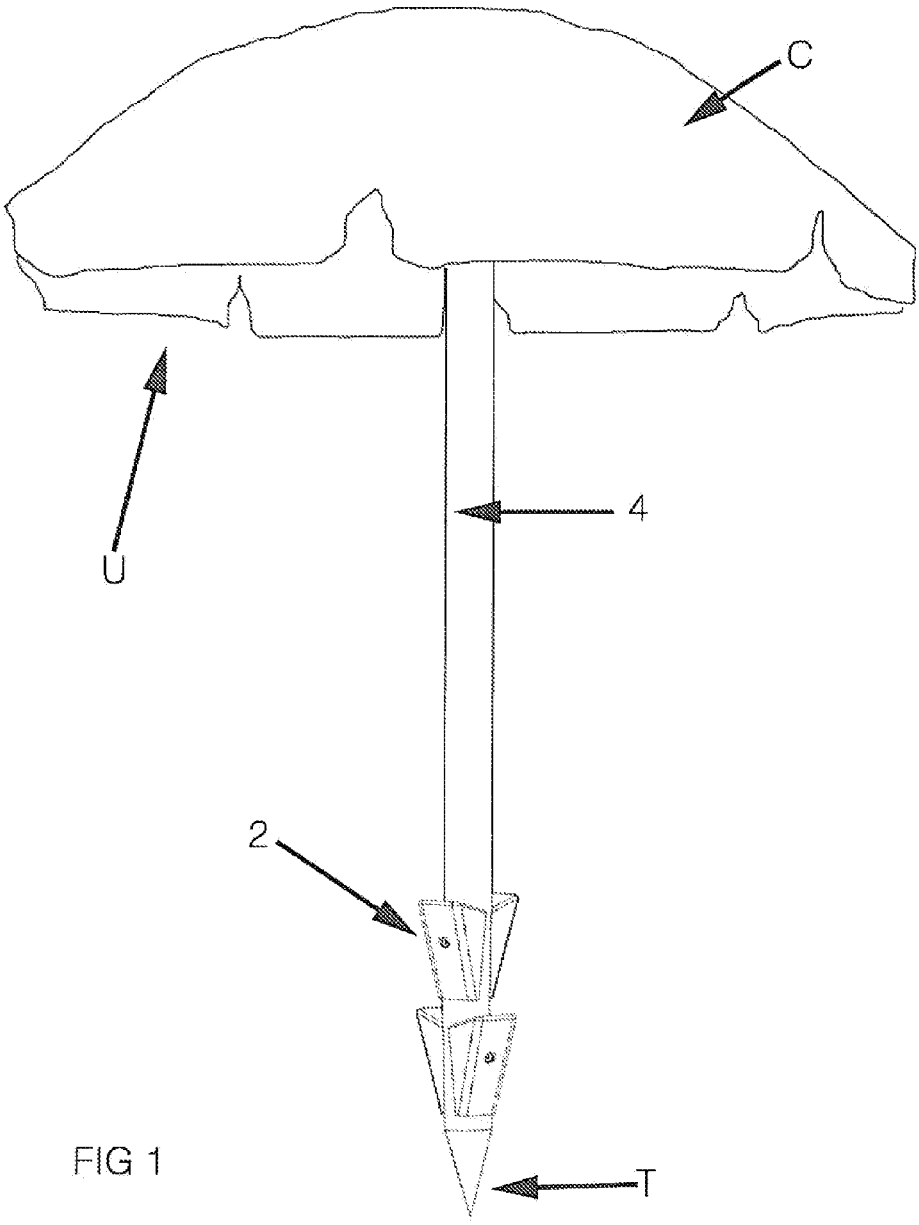
FIG. 1 shows a somewhat diagrammatic elevation view of an umbrella constructed in accordance with this invention.
Figure 2:
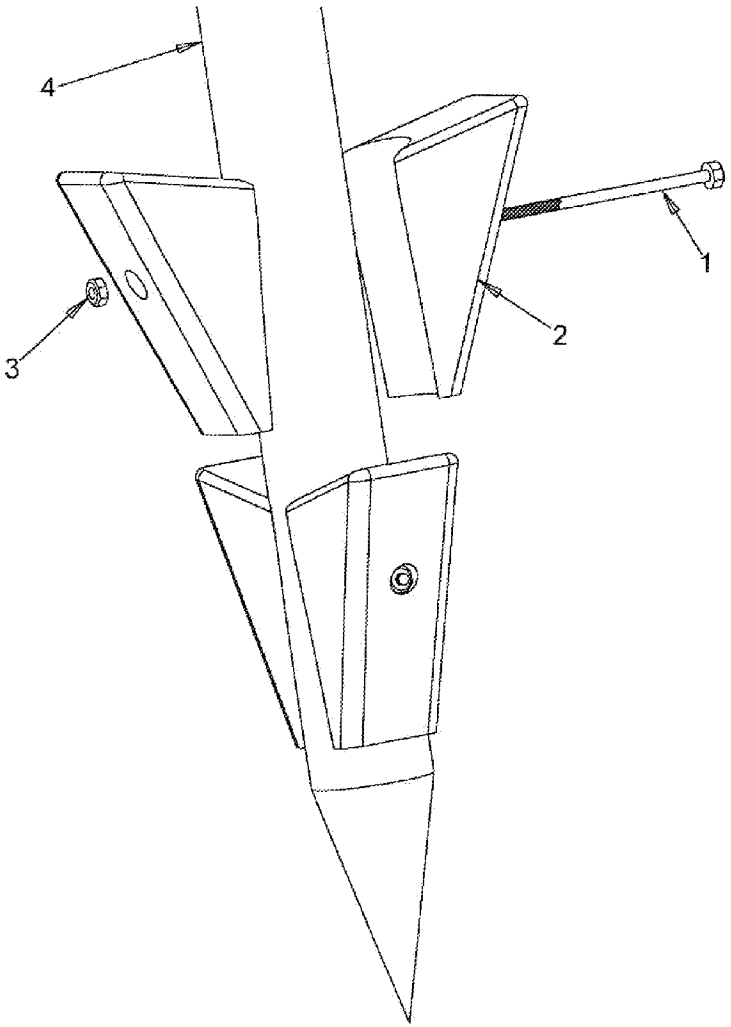
FIG. 2 shows a side elevation view of the lower portion of the shaft for the umbrella of FIG. 1 with several wedges.

Referring now to the drawings, an umbrella U is shown with an open canopy C mounted on a shaft 4 terminating in a tip T that is relatively sharp. Mounted on shaft 4 there are a plurality of wedges 2. The wedges 2 are secured to the shaft 4 by a bolt 1 penetrating the shaft 4 (through a hole 24) and a nut 3. The wedges 2 are preferably arranged in diametrically opposite pairs along the sides of shaft 4. Alternatively, instead of a bolt, the wedges are attached to the shaft using a suitable adhesive. Additionally, as shown in FIG. 1, the wedges may be constructed with openings in the front face to facilitate greater adhesion to the sand as well as reducing the weight and cost of the wedges.

Figure 3C:
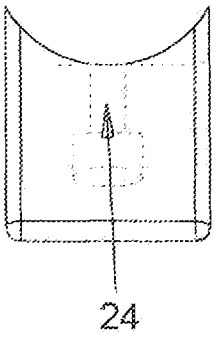
FIG. 3C shows a top view of the wedge.
Figure 3B:
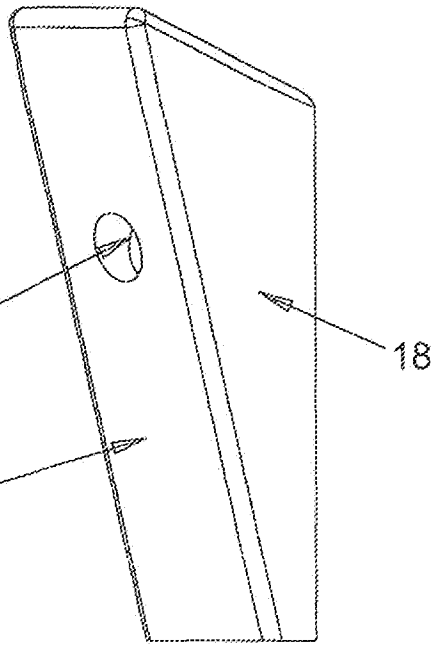
FIG. 3B shows a side sectional view of the wedge of FIG. 3A.
Figure 3A:
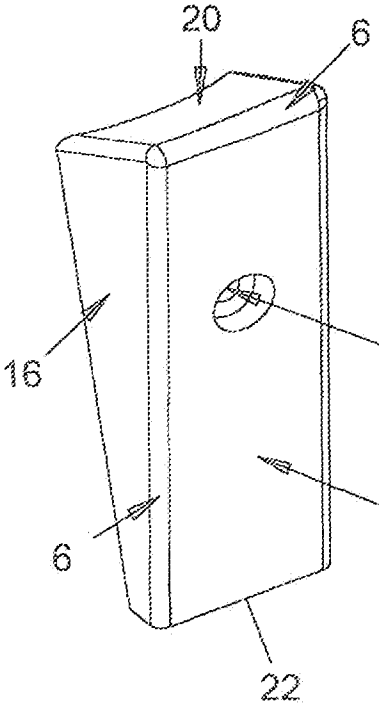
FIG. 3A shows a front view of a wedge attached to the umbrella shaft.

As can be best seen in FIG. 3A-3C, edges of the wedges are rounded as at 6 with a radius of about 1/16 in. Each wedge 2 includes a front face 12, a back face 14, a right and left side 16, 18, a top face 20 and a bottom face 22. Hole 24 extends from the front face 12 to the back face 14 and receives the bolt 1. The back face 14 is shaped to match the outer surface of the shaft 4. In the drawings, shaft 4 and back face 14 are cylindrical.

As shown in the Figures, preferably, top face 20 is not normal to the shaft 4, but instead it is angled upwardly, at an angle ranging from 10 to 30 degrees. This feature increases vertical resistance to withdraw the shaft from the sand.

The wedges may be have an overall height of 3.5 in, and a width of about 1.5 in. In one embodiment, the wedges narrow down slightly from top to bottom, for example from 1.5o in at the top to 1.30 in at the bottom. The wedges may vary in size and shape, and the number of wedges used with a specific umbrella shaft depends on the size and height of the shaft, the size and weight of the umbrella, etc.

The invention provides a simple, inexpensive and light weight configuration that greatly increases the holding forces on the shaft, and, inherently the resistance of the whole umbrella to unwanted removal by wind. Tests have shown that if an umbrella is provided with wedges having the shape and dimensions shown in the figures, the vertical force required to pull it out of sand is approximately five times the force required to pull out the shaft of a standard umbrella.

Planting and removing of the umbrella is accomplished quickly and easily using the same rocking and/or circular motion used to plant a standard umbrella. No additional tools or accessories are necessary. The wedges can be made of inexpensive but durable rustproof materials that are resistant to the marine environment and can be attached to various types of umbrella shafts.

The wedges can be made of metal (such as aluminum alloy) or a high impact plastic material.

In one embodiment, one or more triangular wedges may be constructed of a flexible material. In this latter embodiment, when the umbrella shaft is inserted or planted into sand, the distal tips of the wedges flex inwardly toward the shaft thereby facilitating the umbrella installation or planting. When an upward force is applied to the shaft such as that created by wind blowing against the umbrella canopy, the wedges flex outwardly from the shaft thereby providing even greater resistance to the force on the shaft, and thereby making the shaft even more stable and difficult to remove.

Numerous modifications may be made to this invention without departing from its scope as defined in the appended claims.

I claim:

1. An umbrella, comprising:

a canopy;

a shaft having an elongated body extending along an axis with an outer surface, an upper end configured to support said canopy and a lower end configured to be inserted into the ground;

a plurality of first wedges disposed in a first plane extending transverse to the axis of the shaft, the plurality of first wedges each comprising a first body including a front face, a back face, a right face, a left face, a top face and a bottom face disposed on said outer surface of the shaft near the lower end of the shaft; and a plurality of second wedges arranged in a second plane extending transverse to the axis of the shaft that is offset from the first plane, the plurality of second wedges each comprising a second body including a front face, a back face, a right face, a left face, a top face and a bottom face disposed on the outer surface of the shaft between the top face of each of the plurality of the first wedges and the upper end of the shaft, wherein the right face and the left face of each of the plurality of first wedges extend between the front face, the back face, the top face and the bottom face of the plurality of first wedges forming a substantially triangular first left surface and a substantially triangular first right surface, and the right face and the left face of each of the plurality of second wedges extend between the front face, the back face, the top face and the bottom face of the plurality of second wedges forming a substantially triangular second left surface and a substantially triangular second right surface, wherein each one of the plurality of first wedges are axially offset from each one of the plurality of second wedges such that each one the plurality of first wedges and each one of the plurality of second wedges are interdisposed between each other as viewed along the axis of the shaft, and wherein the plurality of first wedges and the plurality of second wedges are each configured to be inserted into and beneath the ground to secure the umbrella in a desired position.

2. The umbrella as recited in claim 1, wherein the plurality of the first wedges and the plurality of second wedges are arranged in diametrically opposite pairs along said elongated body.

3. The umbrella as recited in claim 1, wherein each of the plurality of the first wedges has a hole extending therethrough between said front face of each of the plurality of first wedges and said back face of each of the plurality of first wedges and each of the plurality of second wedges has a hole extending therethough between the front face of each of the plurality of second wedges and the back face of each of the plurality of second wedges.

4. The umbrella as recited in claim 3, wherein the plurality of first wedges and the plurality of second wedges are configured to be diametrically opposite pairs of each other with each of the plurality of the first wedges are secured to said elongated body by a first bolt that extends through said hole in each of the plurality of the first wedges and a first hole in the elongated body and each of the plurality of the second wedges are secured to the elongated body by a second bolt that extends through the hole in each of the plurality of second wedges and a second hole in the elongated body with the first bolt secured by a first nut engaging the first bolt and the second bolt secured by a second nut engaging the second bolt.

5. The umbrella as recited in claim 1, wherein said elongated body has a cylindrical outer surface.

6. The umbrella as recited in claim 5, wherein the back face of each of the plurality of the first wedges and the back face of each of the plurality of the second wedges is concave in shape to match said outer surface of the shaft.

7. The umbrella as recited in claim 1, wherein the bottom face of the first body of each of the plurality of first wedges and the bottom face of the second body each of the plurality of second wedges extends at a first angle between said front face and said back face of the plurality of first wedges and the front face and the back face of the plurality of second wedges, and the top face of the first body of each of the plurality of first wedges and the bottom face of the second body each of the plurality of second wedges extends at a second angle between the front face and the back face of the plurality of first wedges and the front face and the back face of the plurality of second wedges.

8. The umbrella as recited in claim 1, wherein said top face of each of the plurality of the first wedges and the top face of each of the plurality of the second wedges extends at an angle ranging from 10 to 30 degrees between the rear face and the front face of each of the plurality of the first wedges and the rear face and the front face of each of the plurality of the second wedges.

9. The umbrella as recited in claim 1, wherein each of the plurality of the first wedges and each of the plurality of the second wedges is attached by a bolt to the shaft.

10. The umbrella as recited in claim wherein each of the plurality of the first wedges and each of the plurality of the second wedges is attached by an adhesive to said shaft.

11. The umbrella as recited in claim 1, wherein each of the plurality of the first wedges and each of the plurality of the second wedges has a body with a triangular shape.

12. The umbrella as recited in claim 1, wherein the front face of each of the plurality of the first wedges and the front face of each of the plurality of the second wedges has an opening to facilitate greater adhesion to sand.

13. The umbrella as recited in claim 1, further comprising a tip disposed at the lower end of the shaft, wherein the plurality of the first wedges and the plurality of the second wedges are each generally triangular with the bottom face of each of the plurality of the first wedges and the bottom face of each of the plurality of the second wedges disposed at a predetermined angle with respect to said shaft and the tip disposed below the bottom face of each of the plurality of the first wedges and the bottom face of each of the plurality of the second wedges.

14. The umbrella as recited in claim 1, wherein said shaft is tapered at the lower end thereof.

15. An umbrella, comprising:

a canopy;

a shaft extending along an axis having a body delimited by a top end configured to support said canopy and a bottom end configured to be implanted in the ground;

a plurality of first wedges disposed in a first plane extending transverse to the axis of the shaft, the plurality of first wedges each including a top surface, a bottom surface, a front surface, a first side surface and a second side surface disposed in conjunction with the shaft near said bottom end thereof with said first wedges being inserted into the ground when said shaft is implanted therein and said first wedges having a body sized and shaped to provide a resisting force for removal of the shaft from the ground; and a plurality of second wedges arranged in a second plane extending transverse to the axis of the shaft that is offset from the first plane along the axis of the shaft and toward the second end of the shaft including a top surface, a bottom surface, a front surface, a first side surface and a second side surface disposed in conjunction with the shaft between the top end of the shaft and the top surface of the plurality of the first wedges with the second wedges being inserted into the ground when the shaft is implanted therein and the second wedges having a body sized and shaped to provide a resisting force for removal of the shaft from the ground, wherein each one of the plurality of first wedges is axially offset from each one of the plurality of second wedges such that the plurality of the first wedges and the plurality of the second wedges do not overlap each other as viewed vertically along the length of the shaft, and wherein the plurality of first wedges and the plurality of second wedges each has a substantially triangular shape as viewed from the first side surface and the second side surface of the plurality of first wedges and the plurality of second wedges.

16. The umbrella of claim 14, wherein the plurality of first wedges and the plurality of second wedges each have a body that is generally triangular in shape.

17. An apparatus, comprising:

a shaft including an elongated body extending along an axis that is delimited by a first end and a second end;

a plurality of first wedges arranged in a first horizontal plane extending transverse to the axis of the shaft and including a top surface, a bottom surface, a front surface, a first side surface and a second side surface that are each disposed near the first end of the shaft; and a plurality of second wedges arranged in a second horizontal plane extending transverse to the axis of the shaft that is offset from the first horizontal plane along the axis of the shaft and toward the second end of the shaft and including a top surface, a bottom surface, a front surface, a first side surface and a second side surface that are each disposed between the top surface of each of the plurality of the first wedges and the second end of the shaft, wherein each one of the plurality of first wedges are axially offset from each one of the plurality of second wedges with each one the plurality of first wedges and each one of the plurality of second wedges interdisposed between each other as viewed along the axis of the shaft, wherein each of the plurality of first wedges and the plurality of second wedges have a substantially triangular shape as viewed from the first side surface or the second side surface, and wherein at least the plurality of first wedges and the plurality of second wedges are each configured to be inserted into and beneath the ground to secure the umbrella at a desired position and provide a resisting force for removal of the shaft from the ground.

18. The apparatus of claim 17, wherein each of the plurality of the first wedges and each of the plurality of the second wedges each have a body configured such that the front surface of each of the plurality of first wedges and the front surface of each of the plurality of second wedges is arranged away from the shaft near the top surface of each of the plurality of first wedges and of each of the plurality of second wedges, respectively, at a first distance and extends at angle toward the shaft at the bottom surface of each of the plurality of first wedges and of each of the plurality of second wedges, respectively, where the bottom surface of each of the plurality of first wedges and of each of the plurality of second wedges, respectively, is arranged away from the shaft a second distance that is less than the first distance.

* * * * *